US005524540A

United States Patent [19]

Van Denend

[11] Patent Number: 5,524,540

[45] Date of Patent: Jun. 11, 1996

[54] PRINTING PRESS HAVING DOCTOR BLADE WITH INTEGRAL TAPE SEAL THEREON

[76] Inventor: Mark E. Van Denend, 349 E. 36th St., Paterson, N.J. 07504

[21] Appl. No.: 356,483

[22] Filed: Dec. 15, 1994

[51] Int. Cl.[6] ..... B41F 31/04

[52] U.S. Cl. ..... 101/363; 101/169; 101/366

[58] Field of Search ..... 101/157, 169, 101/207, 208, 167, 210, 321, 326, 340, 347, 363, 364, 365, 120, 366; 118/410, 419, 261, 203, 118, 119; 15/245

[56] References Cited

U.S. PATENT DOCUMENTS

| | | | |
|---|---|---|---|
| 2,313,830 | 3/1943 | Lundbye | 101/169 |
| 2,837,024 | 6/1958 | Dougan | 101/365 |
| 3,788,219 | 1/1974 | Gallagher | 101/425 |
| 3,855,927 | 12/1974 | Simeth | 101/350 |
| 3,866,266 | 2/1975 | Dunlap | 15/256.51 |
| 4,030,410 | 6/1977 | Zimmer | 101/120 |
| 4,078,486 | 3/1978 | Moser | 101/120 |
| 4,184,429 | 1/1980 | Widmer | 101/169 |
| 4,503,770 | 3/1985 | Cox | 101/169 |
| 4,538,518 | 9/1985 | Dahlgren | 101/350 |
| 4,676,160 | 6/1987 | Linska | 101/365 |
| 4,730,416 | 3/1988 | Eames | 49/493 |
| 4,744,571 | 4/1988 | Geberth, Jr. | 277/208 |
| 4,754,701 | 7/1988 | Batke et al. | 101/207 |
| 4,773,327 | 9/1988 | Moetteli | 101/365 |
| 4,981,900 | 1/1991 | Sugawara | 524/496 |
| 5,078,061 | 1/1992 | Messerschmitt | 101/123 |

FOREIGN PATENT DOCUMENTS 56-101853 8/1981 Japan .

*Primary Examiner*—Stephen Funk
*Attorney, Agent, or Firm*—Richard M. Goldberg

[57] ABSTRACT

A doctor blade for a printing press includes a thin unbroken doctoring plate having a rear portion secured to a chamber housing of a printing press and a front portion with a doctoring edge which contacts an outer surface of an ink roll to meter ink thereto; and a thin sealing layer secured across one surface of the thin doctoring plate at a rear portion thereof and spaced away from the doctoring edge so as to be out of contact with the outer surface of the ink roll when the doctor blade is secured in the printing press, the sealing layer being made from a closed cell foam and having a thickness in the range from 0.005 to 0.125 inch, the thin sealing layer being sandwiched between the thin doctoring plate and the chamber housing to prevent migration of ink therebetween.

16 Claims, 3 Drawing Sheets

PRINTING PRESS HAVING DOCTOR BLADE WITH INTEGRAL TAPE SEAL THEREON

BACKGROUND OF THE INVENTION

The present invention relates generally to printing machines, and more particularly, is directed to a doctor blade having an integral tape seal thereon for use in such printing machines.

Conventionally, in printing machines, such as flexographic printing machines, an ink transfer or anilox roll transfers ink to an adjacent plate roll for printing. Ink is supplied to the anilox roll from an ink chamber defined by a chamber housing which partially surrounds the anilox roll. Specifically, ink is supplied through an ink supply tube and then through an ink supply line in the chamber housing, into the ink chamber. In like manner, ink is removed from the ink chamber through an ink return line in the chamber housing and then through an ink return tube.

In order to prevent the escape of ink from the chamber, while ensuring that the ink enters the cells in the anilox roll and has a predetermined thickness on the anilox roll, doctor blades are provided at the entry and exit positions of the anilox roll relative to the ink chamber. The doctor blades are fixed to the chamber housing by bolts so that the doctor blades overhang the chamber housing and contact the anilox roll.

With this arrangement, the outer surface of the anilox roll passes through the ink chamber and picks up ink for printing. The ink is metered by means of the doctor blades held to the inlet and outlet ends of the chamber housing, with the free ends of the doctor blades being in contact with the outer surface of the anilox roll. The doctor blades are clamped to a chamber housing by a clamp holder. However, the housing is typically made of metal so that the seal of the doctor blade to the metal housing is not good, that is, ink always migrates between the doctor blade and the housing, making it difficult to clean. In some instances, in order to prevent migration of ink past the doctor blades, O-ring seals are provided in recesses of the chamber housing, in contact with the doctor blades. However, such external O-ring seals are not entirely satisfactory in performance with respect to sealing of the doctor blades to prevent migration of the ink along the doctor blades, that is, with most clamping assemblies, ink migrates past the doctor blades.

Further, over time, the doctor blades and seals become caked with ink and/or wear out. As a result, the doctor blades and O-ring seals become ineffective for the above purposes, and must be changed. Thus, there is a requirement to change both the doctor blades and the O-ring seals, usually at different times. In addition, changing of the O-ring seals can be difficult and burdensome.

Although doctor blades are known which have a coating thereon, such coatings are not effective for providing a seal to prevent migration of ink along the doctor blades.

For example, U.S. Pat. No. 2,837,024 to Dougan is directed to an offset press having an ink fountain blade with slots therein, thus effectively providing a plurality of side-by-side doctor blade segments. The different doctor blade segments separated by the slots can be individually biased by different amounts so that different amounts of ink can be placed on the roll at different positions corresponding thereto.

A continuous sheet of a thin, resilient material extends at least from the metering edge of the blade back to a position close to the rear edge of the blade. The resilient material may be a synthetic rubber or a suitable resilient plastic which is resistant to petroleum base solvents and varnishes such as are used in ink manufacture and in the cleanup of the press. The rubber is vulcanized to the steel of the blade. The primary purpose of the rubber is to prevent leakage of ink between the slots.

However, in order to prevent ink from escaping through the slots, the rubber layer must extend to the surface of the ink roll, and therefore, be in contact with the ink roll. If the rubber layer is spaced away from the doctoring edge, it would permit ink to pass through the slots, and therefore, would be inoperative for its intended purpose.

However, to obtain accurate metering of the ink, only the metal or plastic portion of the doctor blade should be in contact with the anilox roll.

U.S. Pat. No. 2,313,830 to Lundbye discloses a doctor blade formed by a thin steel blade having a layer of graphite secured along its undersurface. However, the graphite compound extends to the doctoring edge, and is in fact the edge in contact with the ink roll. The purpose thereof is to prevent wear and scratching of the ink cylinder, and the function of such graphite layer is not to provide any sealing function.

Japanese Patent Publication No. 56-101853 discloses a doctor blade comprised of a soft fluorine rubber plate or polyamide plate and a firm steel, polyester or polycarbonate plate secured therewith by screws, adhesives or the like. As with Lundbye, the soft fluorine rubber plate or polyamide plate extends to the doctoring edge, and is in fact, in contact with the ink roll, for the same purpose as in Lundbye.

OBJECTS AND SUMMARY OF THE INVENTION

Accordingly, it is an object of the present invention to provide a doctor blade having an integral tape seal thereon that overcomes the problems with the prior art.

It is another object of the present invention to provide a doctor blade having an integral tape seal thereon, which eliminates ink migration.

It is still another object of the present invention to provide a doctor blade having an integral tape seal thereon, which eliminates the need for conventional O-ring seals.

It is yet another object of the present invention to provide a combined doctor blade and seal which together form a unitary throw-away item.

It is a further object of the present invention to provide a doctor blade having a continuous, unbroken doctoring edge in contact with the anilox roll, with a thin sealing layer secured thereto but spaced away from the doctoring edge and away from the surface of the roll.

It is a still further object of the present invention to provide a printing press having the aforementioned doctor blade, in which the thin sealing layer is pressed against the chamber housing to prevent migration of ink along the doctor blade.

In accordance with an aspect of the present invention, a doctor blade includes a thin unbroken doctoring plate having a rear portion to be secured in a printing press and a front portion with a doctoring edge which contacts an outer surface of an ink roll to meter ink thereto; and a thin sealing layer secured across a surface of the thin doctoring plate and spaced away from the doctoring edge so as to be out of contact with the outer surface of the ink roll when the doctor blade is secured in the printing press.

The sealing layer is adhered to one surface at a rear portion of the doctoring plate, and is made from a material selected from the group consisting of a closed cell foam, a rubber and any other elastomer material. Preferably, the thin sealing layer is made from a material selected from the group consisting of a closed cell polyethylene, a closed cell polypropylene and an EPDM rubber material. A closed cell foam is advantageous because when the seal is clamped, the sealing material is not deformed in a way which affects the straightness or planar nature of the doctor blade. Further, a closed cell foam will not absorb ink in a way that an open cell foam will. It is further noted that the material that is selected must relate to the chemical resistance of the ink that is being used. The thin sealing layer has a thickness in the range from 0.005 to 0.125 inch.

In accordance with an aspect of the present invention, a printing press includes a chamber housing positioned adjacent an ink roll; and a doctor blade having a rear portion thereof clamped to the chamber housing, the doctor blade including a thin unbroken doctoring plate having a front doctoring edge which contacts an outer surface of the ink roll to meter ink to the ink roll; and a thin sealing layer secured across a surface of the thin doctoring plate and spaced away from the doctoring edge so as to be out of contact with the outer surface of the ink roll when the doctor blade is clamped to the chamber housing, the thin sealing layer being sandwiched between the thin doctoring plate and the chamber housing to prevent migration of ink therebetween.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
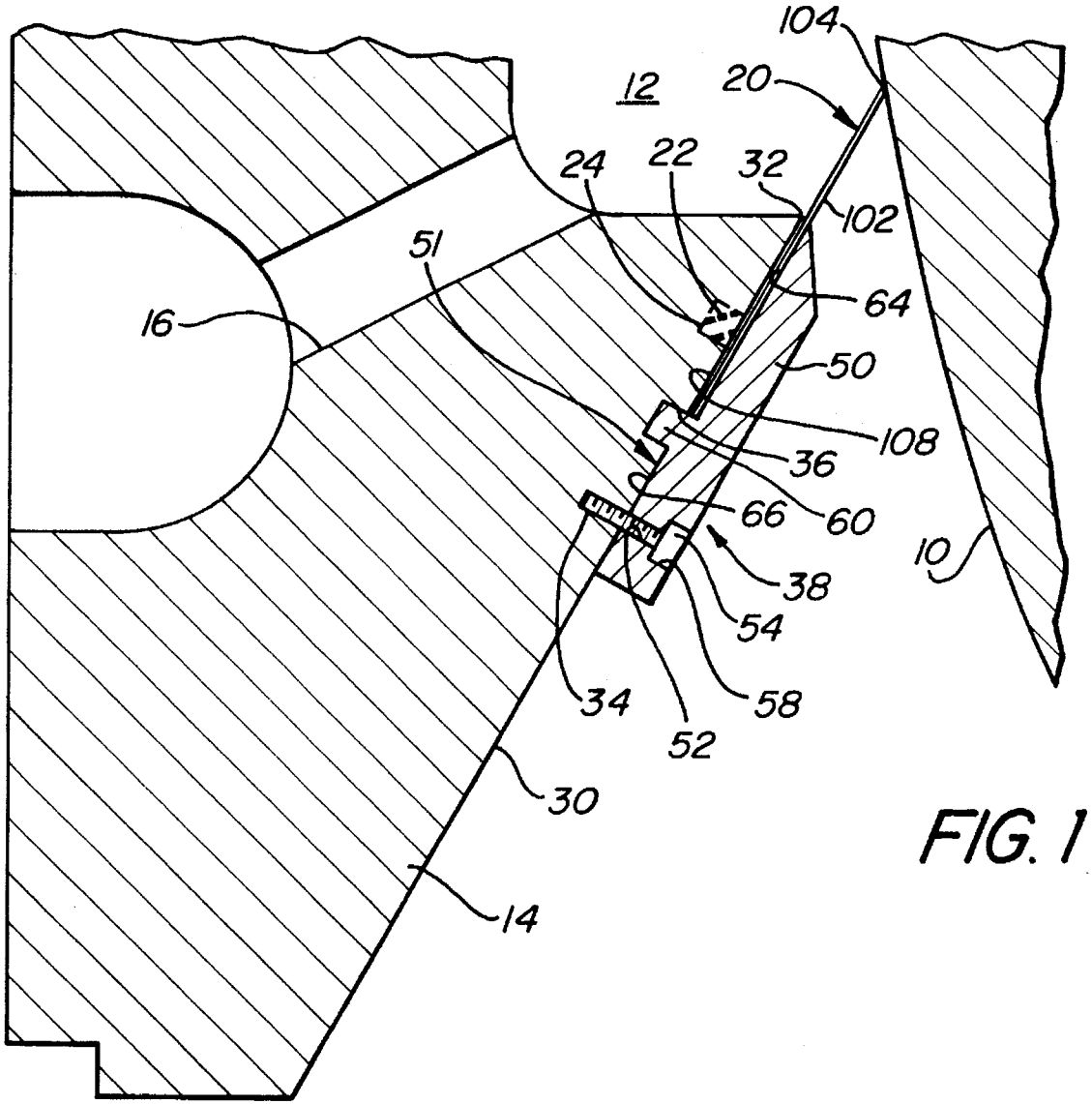
FIG. 1 is cross-sectional view of a portion of a chamber housing with a doctor blade according to the present invention clamped to the chamber housing by a doctor blade clamping assembly.

Reference will first be made to FIG. 1, which shows a portion of a conventional flexographic printing press. As shown therein, an ink transfer or anilox roll 10 transfers ink to an adjacent plate roll (not shown) for printing. Ink is supplied to anilox roll 10 from an ink chamber 12 defined by a chamber housing 14 which partially surrounds anilox roll 10. Specifically, ink is supplied to ink chamber 12 through an ink supply line 16 in chamber housing 14, and ink is removed from ink chamber 12 through an ink return line (not shown) on the other side of chamber housing 14.

With this arrangement, the outer surface of anilox roll 10 passes through ink chamber 12 and picks up ink for printing. The ink is metered by means of doctor blades 20 held to the inlet and outlet ends of chamber housing 14, with the free ends of doctor blades 20 being in contact with the outer surface of anilox roll 10. Housing 14 is typically made of metal so that the seal of the doctor blade to the metal housing is not good, that is, ink always migrates between doctor blade 20 and housing 14, making it difficult to clean. In some instances, O-ring seals 22 shown in FIG. 1, have been provided in recesses 24 of chamber housing 14, in contact with doctor blades 20, to prevent migration of ink. O-ring seals 22 and recesses 24 are shown by dashed lines, since such O-ring seals 22 and recesses 24 are eliminated by the present invention.

Chamber housing 14 includes inclined surfaces 30 at the inlet and outlet ends thereof that converge in directions toward each other, and which terminate at inner edges 32 thereof corresponding to the outer boundaries of ink chamber 12. At least one threaded bolt hole 34 is provided in each inclined surface 30, along with a larger recess 36 spaced inwardly from threaded bolt hole 34.

With this arrangement, a doctor blade 20 is positioned against each inclined surface 30 such that the front or doctoring edges 104 of doctor blades 20 are in contact with anilox roll 10. In this position, O-ring seals 22 would conventionally be provided to prevent migration of ink between doctor blades 20 and inclined surfaces 30 at the inlet and the outlet.

In order to clamp each doctor blade 20 in this position, clamp means 38 is secured to each inclined surface 30 so as to partially overlie and clamp doctor blades 20, thereby applying a biasing force to doctor blades 20 to retain the same in position. Specifically, each clamp means 38 includes a block 50 having a surface 51 which seats on inclined surface 30. Block 50 includes a hole 52 at the rear thereof for receiving a bolt 54 therethrough. Accordingly, when bolt 54 extends through hole 52, it is threadedly engaged within threaded bolt hole 34 in inclined surface 30 so as to secure block 50 to chamber housing 14. Preferably, a recessed opening 58 is provided in block 50 for receiving the head of bolt 54.

A stop pin 60 extends from the inner surface of block 50 at a position spaced inwardly of hole 52, and engages within recess 36 in inclined surface 30 of chamber housing 14. Stop pin 60 has a two-fold function of positioning block 50 with respect to chamber housing 14, and also acting as a stop against which the rear edge of doctor blade 20 abuts to correctly position doctor blade 20. In this regard, it is noted that the inner portion 64 of surface 51 of block 50 which is positioned inwardly of stop pin 60 and adjacent to inclined surface 30 is raised slightly with respect to the outer portion 66 of surface 51 of block 50 which is positioned outwardly of stop pin 60 and rests against inclined surface 30, in order to provide room for receiving doctor blade 20 between inner portion 64 and inclined surface 30 of chamber housing 14.

With this arrangement, doctor blade 20 is clamped between block 50 and chamber housing 14, such that the doctoring edge 104 of doctor blade 20 is in contact with anilox roll 10 to meter the ink therein.

As discussed above, the metal to metal contact of doctor blades 20 to housing 14 results in ink leakage. Further, the use of O-ring seals 22 is disadvantageous. First, such O-ring seals 22 are not entirely satisfactory in performance for sealing of doctor blades 20, that is, there is still ink migration. Further, doctor blades 20 and seals 22 become caked with ink and/or wear out. As a result, doctor blades 20 and O-ring seals 22 become ineffective for the above purposes, and must be changed. Thus, there is a requirement to change both doctor blades 20 and the O-ring seals 22, usually at different times. In addition, changing of O-ring seals 22 can be difficult and burdensome.

Figure 2:
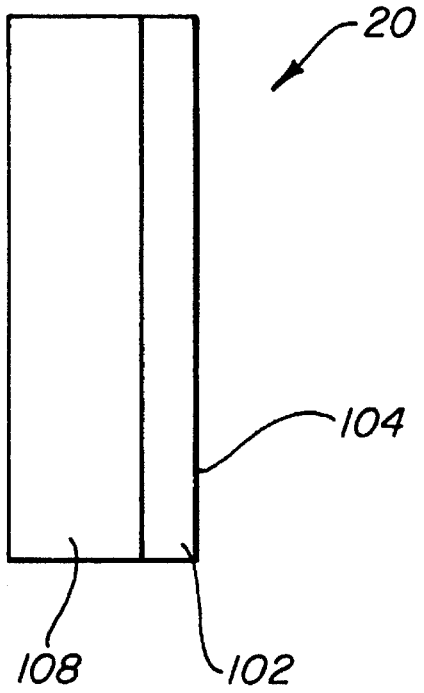
FIG. 2 is top plan view of the doctor blade having an integral tape seal thereon according to the present invention.
Figure 3:
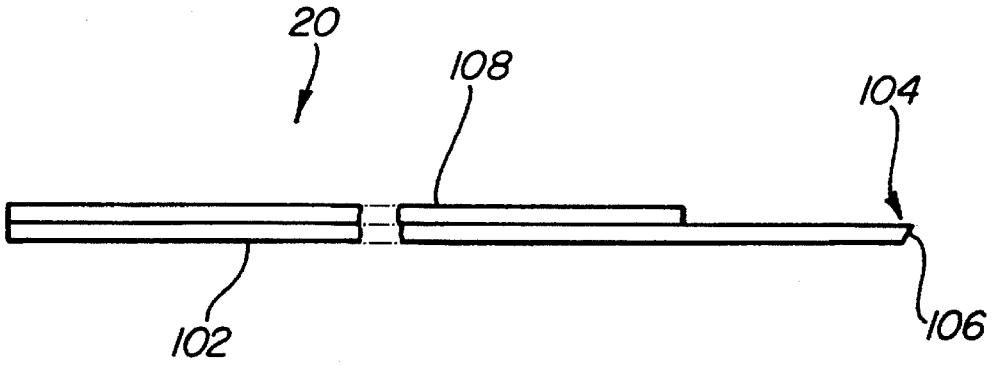
FIG. 3 is an enlarged end elevational view of the doctor blade of FIG. 1.

In accordance with the present invention, as shown in FIGS. 2 and 3, doctor blade 20 includes a thin doctoring plate 102 of stainless steel, blue steel, plastic or other flexible material, having a generally rectangular configuration. Preferably, the thickness of thin doctoring plate 102 is similar to that of conventional doctor blades, and is generally within the range of 0.003 inch to 0.125 inch. The dimensions and shape can vary, as with conventional doctor blades. As an example, thin doctoring plate 102 can have a length of approximately three inches and a width of approximately one inch. Thin doctoring plate 102 has a front portion with a single continuous, unbroken doctoring edge 104 which contacts the outer surface of anilox roll 10 for metering the ink thereto. Preferably, doctoring edge 104 has an inclined face 106 to conform to the outer surface of anilox roll 10 when pressed thereagainst. Alternatively, doctoring edge 104 can have a squared off face, a stepped face or the like, as is conventional.

A thin sealing layer 108 such as a tape, is adhered by any permanent adhesive, to the upper surface of thin doctoring plate at a rear portion of thin doctoring plate 102 to prevent migration of the ink between thin doctoring plate 102 and inclined surface 30 of chamber housing 14. The sealing material of thin sealing layer 108 can be made from any suitable material such as a closed cell foam, rubber or any other elastomer material. For example, suitable closed cell materials are closed cell polyethylene and closed cell polypropylene, and a suitable rubber material is EPDM. For example, thin sealing layer 108 can be made form a low density polyethylene (LDPE) material, which is a closed cell polyethylene, such as the material sold under the trademark "DUPLOMONT 950" by Lohmann Klebebandsysteme GmbH & Co. of Germany. The latter material has a thickness of 0.9 mm (0.035 inch) and has a very tight thickness tolerance variation. It is essential that the sealing material provide good sealing characteristics so that the ink cannot migrate therethrough, and so that it forms an effective seal with inclined surface 30. Although not limited, thin sealing layer 108 preferably has a thickness from 0.005 to 0.125 inch.

A closed cell foam is advantageous because when the seal is clamped, the sealing material is not deformed in a way which affects the straightness or planar nature of doctor blade 20. Further, a closed cell foam will not absorb ink in a way that an open cell foam will. It is further noted that the material that is selected must relate to the chemical resistance of the ink that is being used.

It is important, however, that thin sealing layer 108 not extend to doctoring edge 104 and thereby, is not in contact with anilox roll 10 so as not to interfere with the doctoring operation by doctoring edge 104. For example, as shown in FIG. 2, thin sealing layer 108 may extend from the rear edge of thin doctoring plate 102 to a position approximately one-quarter inch away from doctoring edge 104, although the present invention is not limited to this exact dimension. This is because thin sealing layer 108 would result in a poor doctoring operation by doctor blade 20 if it contacted anilox roll 10. Thus, sealing layer 108 may extend to the position of inner edge 32 of inclined surface 30 when positioned as shown in FIG. 1.

As a result of this arrangement, when doctor blade 20 is clamped in the arrangement of FIG. 1, thin sealing layer 108 is pressed against inclined surface 30 to form an effective seal against migration of ink between chamber housing 14 and thin doctoring plate 102.

Thus, O-ring seals 22 used with conventional doctor blades can be eliminated, thereby simplifying the construction. It will be appreciated that when doctor blade 20 is changed, the seal which is formed by thin sealing layer 108 and adhered thereto is thrown away with the doctor blade. Thus, each time that the doctor blade 20 is changed, a new seal is automatically provided. Therefore, the problems associated with conventional O-ring seals 22 are eliminated.

Figure 4:
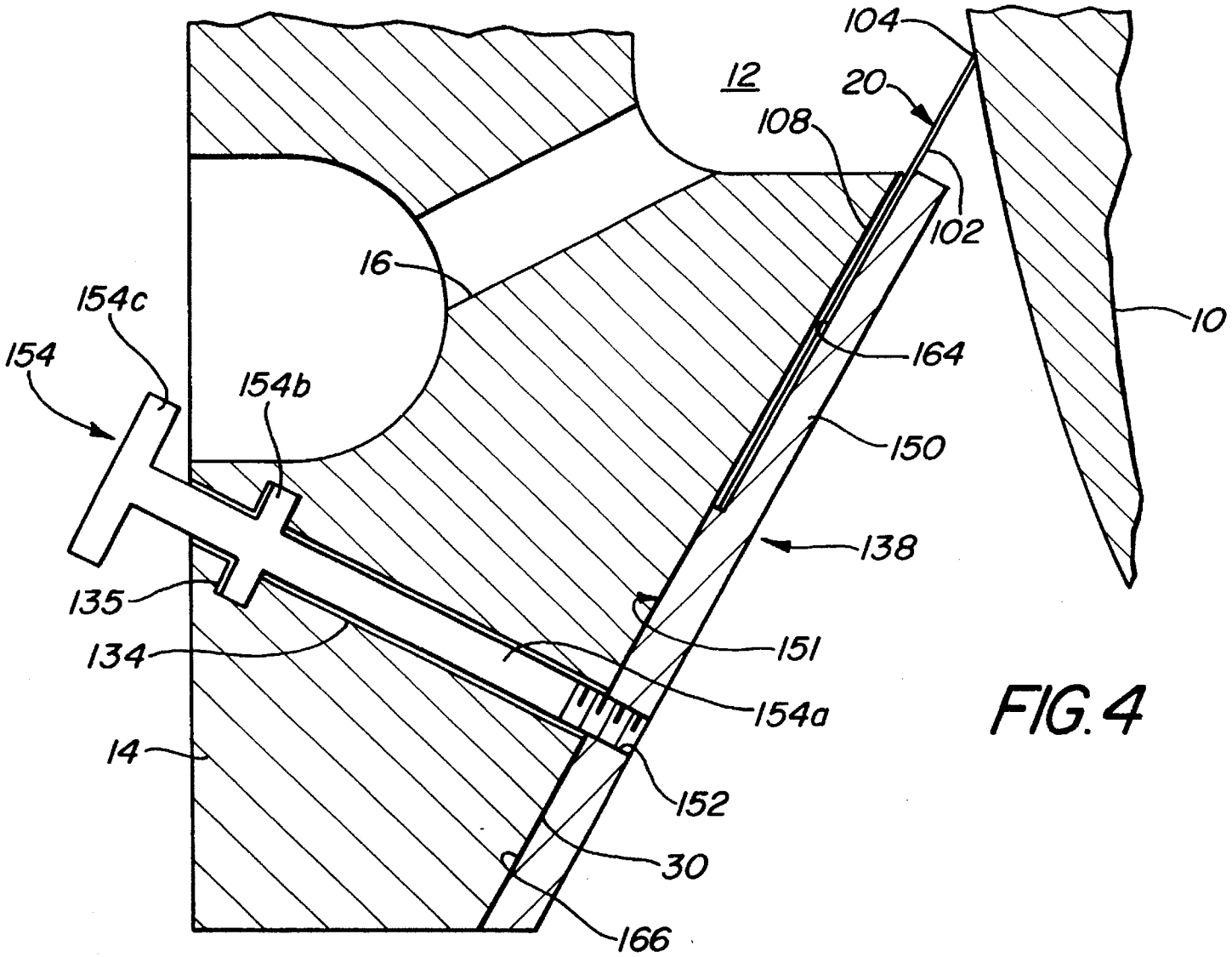
FIG. 4 is a cross-sectional view of a portion of a chamber housing with a doctor blade according to the present invention clamped to the chamber housing by a different doctor blade clamp means.

Referring to FIG. 4, there is shown a cross-sectional view of a portion of a chamber housing with a doctor blade according to the present invention clamped to the chamber housing by a different doctor blade clamp means 138, in which elements corresponding to those of FIG. 1 are identified by the same reference numerals, augmented by 100, and a detailed description thereof will be omitted for the sake of brevity.

As shown therein, chamber housing 14 includes a hole 134 therethrough, with hole 134 having a larger diameter area 135 near the upper end thereof.

A clamping bolt 154 has a shaft **154*a* that extends through hole 134, an enlarged cylindrical portion 154*b* secured to an upper portion of shaft 154*a* and which rotatably seats within larger diameter area 135, and an enlarged thumb screw head 154*c*** that can be rotated by an operator's fingers.

Clamp means 138 includes a block 150 having a surface 151 which seats on inclined surface 30. Block 150 includes a threaded hole 152 at the rear thereof for threadedly receiving the threaded end of clamping bolt 154.

Accordingly, when bolt 154 extends through hole 134, it is threadedly engaged within threaded hole 152 so as to secure block 150 to chamber housing 14. The amount of force that is applied to block 150 will vary upon the turning of head **154*c***.

Further, the inner portion 164 of surface 151 of block 150 which is adjacent to inclined surface 30 is raised slightly with respect to the outer portion 166 of surface 151 of block 150, in order to provide room for receiving doctor blade 20 between inner portion 164 and inclined surface 30 of chamber housing 14. As a result, a stop shoulder is provided at the junction of inner portion 164 and outer portion 166 which acts as a stop against which the rear edge of doctor blade 20 abuts to correctly position doctor blade 20. In this regard, doctor blade 20 is clamped between block 150 and chamber housing 14, such that the doctoring edge 104 of doctor blade 20 is in contact with anilox roll 10 to meter the ink therein.

Although the present invention has been discussed in relation to chamber doctor blades, it will be appreciated that the invention is not limited thereto, and is applicable to doctor blades having other uses.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. For use with a printing press having an ink roll with an outer surface, a doctor blade comprising:

a thin unbroken doctoring plate having:

a rear portion to be secured in the printing press a front portion including a doctoring edge contacts the outer surface of the ink roll to meter ink thereto, and a surface; and a thin sealing layer permanently fixed across the surface of said thin doctoring plate and spaced away from said doctoring edge so as to be out of contact with the outer surface of said ink roll when said doctor blade is secured in said printing press.

2. A doctor blade according to claim 1, further comprising means for adhering said thin sealing layer to said surface at the rear portion of said doctoring plate.

3. A doctor blade according to claim 1, wherein the thin sealing layer is made from a material selected from the group consisting of a closed cell foam, a rubber and any other elastomer material.

4. A doctor blade according to claim 3, wherein the thin sealing layer is made from a material selected from the group consisting of a closed cell polyethylene, a closed cell polypropylene and an EPDM rubber material.

5. A doctor blade according to claim 1, wherein said thin sealing layer has a thickness in the range from 0.005 to 0.125 inch.

6. A printing press comprising:

an ink roll having an outer surface;

a chamber housing positioned adjacent the ink roll; and a doctor blade having a rear portion thereof clamped to said chamber housing, said doctor blade including:

a thin unbroken doctoring plate having:

a front doctoring edge which contacts the outer surface of the ink roll to meter ink to the ink roll, and a surface; and a thin sealing layer permanently fixed across the surface of said thin doctoring plate and spaced away from said doctoring edge so as to be out of contact with the outer surface of the ink roll when said doctor blade is clamped to said chamber housing, said thin sealing layer being sandwiched between said thin doctoring plate and said chamber housing to prevent migration of ink therebetween.

7. A printing press according to claim 6, further comprising means for adhering said thin sealing layer to said surface at the rear portion of said doctoring plate.

8. A printing press according to claim 6, wherein the thin sealing layer is made from a material selected from the group consisting of a closed cell foam, a rubber and any other elastomer material.

9. A printing press according to claim 8, wherein the thin sealing layer is made from a material selected from the group consisting of a closed cell polyethylene, a closed cell polypropylene and an EPDM rubber material.

10. A printing press according to claim 6, wherein said thin sealing layer has a thickness in the range from 0.005 to 0.125 inch.

11. A printing press according to claim 6, further comprising means for clamping the rear portion of said doctor blade to said chamber housing.

12. For use with a printing press having an ink roll with an outer surface and extending in an axial direction, a doctor blade comprising:

a thin unbroken doctoring plate having:

a rear portion to be secured in the printing press, a front portion with a doctoring edge having a length which extends in said axial direction and for contact with the outer surface of the ink roll to meter ink thereto, and a surface; and a sealing layer permanently fixed across the surface of said thin doctoring plate and spaced away from said doctoring edge so as to be out of contact with the outer surface of said ink roll when said doctor blade is secured in said printing press, such that the sealing layer is always automatically removed from the printing press when the doctoring plate is removed from the printing press, said sealing layer having a length extending in said axial direction at least equal to the length of said doctoring edge.

13. A doctor blade according to claim 12, further comprising means for adhering said sealing layer to said surface at the rear portion of said doctoring plate.

14. A doctor blade according to claim 12, wherein the sealing layer is made from a material selected from the group consisting of a closed cell foam, a rubber and any other elastomer material.

15. A doctor blade according to claim 14, wherein the sealing layer is made from a material selected from the group consisting of a closed cell polyethylene, a closed cell polypropylene and an EPDM rubber material.

16. A doctor blade according to claim 12, wherein said sealing layer has a thickness in the range from 0.005 to 0.125 inch.

* * * * *

UNITED STATES PATENT AND TRADEMARK OFFICE

CERTIFICATE OF CORRECTION

PATENT NO. : 5,524,540

DATED : JUNE 11, 1996

INVENTOR(S) : MARK E. VAN DENEND

It is certified that error appears in the above-indentified patent and that said Letters Patent is hereby corrected as shown below:

Column 6, line 60, change "contacts" to --for contact with--.

Signed and Sealed this

Fifteenth Day of October, 1996

*Attest:*

*Attesting Officer*

BRUCE LEHMAN

*Commissioner of Patents and Trademarks*